US008766122B2

(12) United States Patent
Takiguchi et al.

(10) Patent No.: US 8,766,122 B2
(45) Date of Patent: Jul. 1, 2014

(54) PUSH TYPE SWITCH

(75) Inventors: Tsuyoshi Takiguchi, Tachikawa (JP); Naoki Iwao, Hino (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 891 days.

(21) Appl. No.: 11/126,127

(22) Filed: May 10, 2005

(65) Prior Publication Data

US 2005/0284743 A1 Dec. 29, 2005

(30) Foreign Application Priority Data

Jun. 23, 2004 (JP) ..... 2004-184551

(51) Int. Cl.
*H01H 3/12* (2006.01)
*H01H 13/14* (2006.01)

(52) U.S. Cl.
USPC ..... 200/341

(58) Field of Classification Search
USPC ..... 200/341–345, 520
See application file for complete search history.

(56) References Cited

U.S. PATENT DOCUMENTS

| | | | | |
|---|---|---|---|---|
| 3,484,090 | A * | 12/1969 | Mahoney | 267/114 |
| 4,851,623 | A * | 7/1989 | Honda et al. | 200/314 |
| 5,420,386 | A * | 5/1995 | Reinelt | 200/302.2 |
| 6,455,795 | B1 * | 9/2002 | Murakami et al. | 200/345 |
| 6,569,794 | B1 * | 5/2003 | Reid et al. | 501/95.2 |
| 6,900,404 | B2 * | 5/2005 | Searle et al. | 200/341 |
| 2005/0233913 | A1 * | 10/2005 | Wayne | 508/577 |
| 2006/0002884 | A1 * | 1/2006 | Golz-Berner et al. | 424/74 |

FOREIGN PATENT DOCUMENTS

JP 2004-71306 A 3/2004

* cited by examiner

*Primary Examiner* — R S Luebke
*Assistant Examiner* — Lheiren Mae Caroc
(74) *Attorney, Agent, or Firm* — Holtz Holtz Goodman & Chick PC

(57) ABSTRACT

A push type switch which enables an operator to obtain an upscale impression when he operates the push type switch. A switch body 3 is rigidly fixed to a printed wiring board 5. A casing 7 having a plurality of guide grooves 71*h* is fixed to the printed wiring board 5. A plurality of rails 91*a* provided on a knob 9 capable of transmitting a pushing force to the switch body 3 are slidably inserted into the guide grooves 71*h* such that the knob 9 can slide on the casing 7. A grease is applied to the guide grooves 71*h* and the rails 91*a*. The viscosity of the grease is set to be within a range of 1000 to 2750 Pa.

4 Claims, 20 Drawing Sheets

EVALUATION ITEMS AND EVALUATION SCORES ON A SEVEN-POINT SCALE

| | VERY SO | | SO | | SLIGHTLY SO | | NEUTRAL | | SLIGHTLY SO | | SO | | VERY SO | |
|---|---|---|---|---|---|---|---|---|---|---|---|---|---|---|
| | 3 | | 2 | | 1 | | 0 | | -1 | | -2 | | -3 | |
| NO RATTLING | | | | | | | | | | | | | | RATTLING |
| LOW NOISE | | | | | | | | | | | | | | LARGE NOISE |
| SOFT FEELING | | | | | | | | | | | | | | NO SOFT FEELING |

PUSH TYPE SWITCH

BACKGROUND OF THE INVENTION

1. Field of the Invention

The present invention relates to a push type switch, and more particularly to a push type switch which is capable of creating an upscale impression when operating (pushing) the push type switch.

2. Description of the Related Art

Conventionally, a key switch is known which is comprised of a membrane substrate, a pair of fixed contact points, a click rubber, a frame, and a key top (see e.g. Japanese Laid-Open Patent Publication (Kokai) No. 2004-71306 (Paragraph numbers [0011] to [0014], FIG. 1))

The membrane substrate is disposed on a chassis e.g. of electronic equipment.

The pair of fixed contact points are provided on the membrane substrate.

The click rubber has a generally domed shape, and covers the pair of fixed contact points. The click rubber has a conductive rubber provided on an inner surface thereof. The conductive rubber is opposed to the pair of fixed contact points in a manner spaced therefrom.

The frame is opposed to the membrane substrate and the click rubber in a manner slightly spaced therefrom. The frame includes a slide guide that has a hollow cylindrical shape.

The key top has a sliding portion. The sliding portion is in the form of an octagonal column and inserted into the slide guide, such that it slides in the direction of the thickness of the chassis.

The slide guide and the sliding portion are coated with a grease for smooth sliding and reduction of generation of noise.

When the key top is pushed with a finger, the sliding portion is caused to slide to press the click rubber. When the click rubber is pressed to a certain extent, it is inverted in shape, i.e. changed from a convex state into a concave state, whereby the conductive rubber is brought into contact with the pair of fixed contact points. As a result, the pair of fixed contact points are closed. Further, when the click rubber is inverted in shape, a click feeling is created.

When the finger is released from the key top, the key top returns to its original position by the resilience thereof, and the conductive rubber moves away from the pair of fixed contact points.

An upscale impression is demanded of a push type switch disposed on an instrumental panel for an automotive vehicle.

To impart the upscale impression to the above key switch, it is envisaged to use an expensive material for the key top, or decorates the key top with a special color or pattern.

However, there was a limit to creating the upscale impression, unless an operation feeling in operating the key switch is enhanced.

SUMMARY OF THE INVENTION

The present invention has been made in view of these circumstances, and an object thereof is to provide a push type switch which is capable of causing an operator to sense an upscale impression when he operates the push type switch.

To attain the above object, the present invention provides a push type switch comprising a switch body, a fixing member to which the switch body is rigidly fixed, a movable member slidably supported by the fixing member such that the movable member can transmit a pushing force to the switch body, and a grease applied to sliding portions of the fixing member and the movable member, wherein a viscosity of the grease is within a range of 1000 to 2750 Pa.

According to this push type switch, the viscosity of the grease is within a range of 1000 to 2750 Pa, so that when an operator pushes the movable member with his finger, he feels that an appropriate weight (a force his fingertip receives from the grease) is transmitted to his fingertip, and recognizes that the movable member is moved more slowly than in the prior art. Further, the operator can feel that rattling of the movable member and generation of noise are more suppressed than in the prior art. As a result, the push type switch according to the present invention is capable of giving an upscale impression to the operator when he operates the push type switch.

Preferably, the grease is a fluorine-based grease.

According to this preferred embodiment, since the grease is a fluorine-based grease, no significant changes in the viscosity are caused by temperature. As a result, it is possible to prevent the operation feeling from being changed due to changes in temperature.

Preferably, a guide groove is formed in one of the fixing member and the movable member, and a rail for sliding relative to the guide groove is formed on the other of the fixing member and the movable member.

According to this preferred embodiment, a guide groove is formed in one of the fixing member and the movable member, and a rail for sliding relative to the guide groove is formed on the other of the fixing member and the movable member. Therefore, the movable member can slide more stably. Further, according to the present invention, it is possible to further enhance the upscale impression during operation of the push type switch.

More preferably, a first grease reservoir is formed in at least one of the guide groove and the rail.

According to this preferred embodiment, since a first grease reservoir is formed in at least one of the guide groove and the rail, loss of the grease is caused only in a small amount even after the push type switch is used for a long time period. This makes it possible to maintain an excellent operation feeling for a long time period.

More preferably, a second grease reservoir is formed in one end of either the guide groove or the rail.

According to this preferred embodiment, since a second grease reservoir is formed in one end of either the guide groove or the rail, loss of the grease is caused only in a small amount even after the push type switch is used for a long time period. This makes it possible to maintain an excellent operation feeling for a long time period.

The above and other objects, features and advantages of the present invention will become more apparent from the following detailed description taken in conjunction with the accompanying drawings.

DETAILED DESCRIPTION OF THE PREFERRED EMBODIMENTS

Hereinafter, preferred embodiments of the present invention will be described in detail with reference to the drawings.

Figure 1:
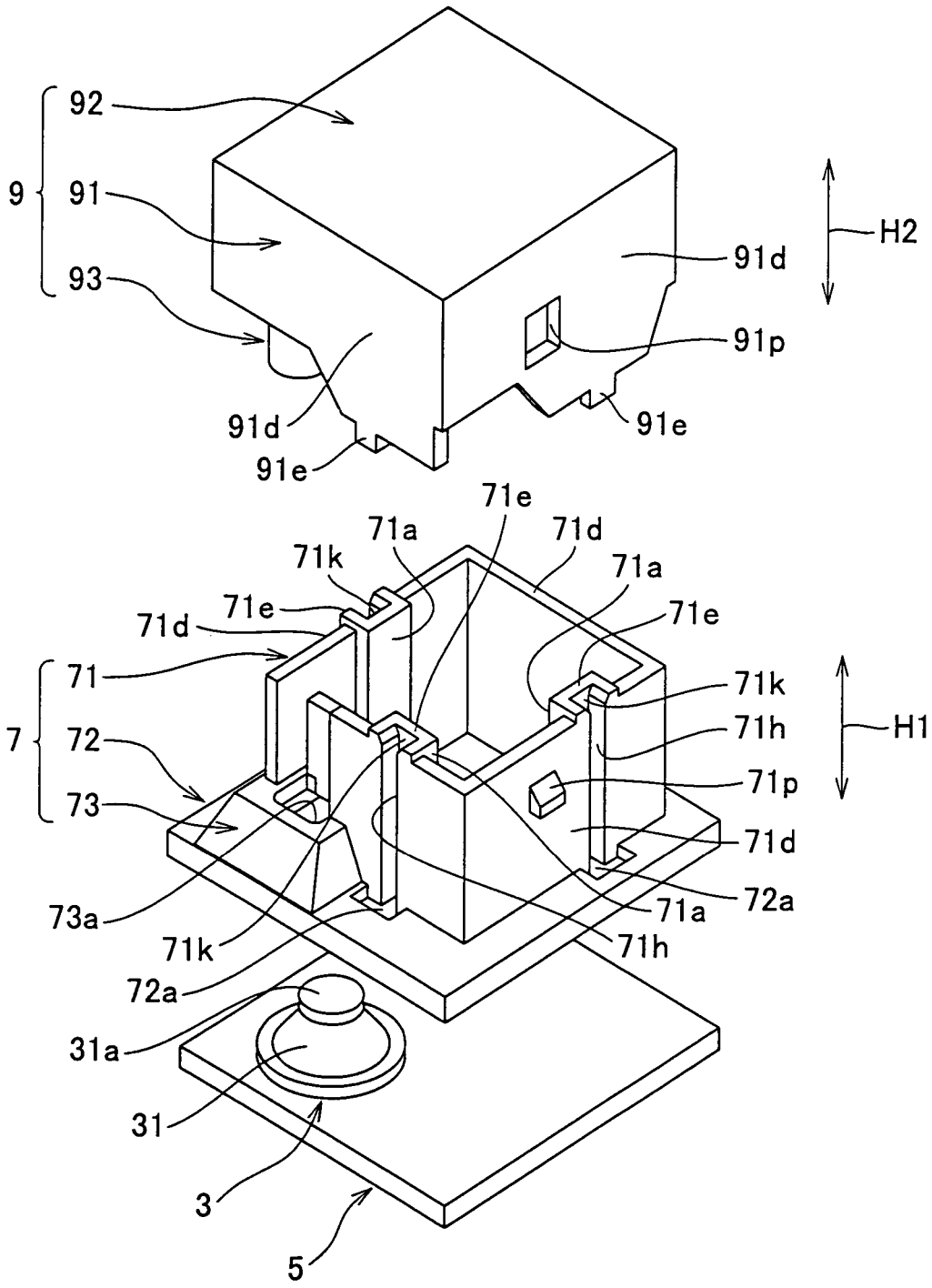
FIG. 1 is an exploded perspective view of a push type switch according to a first embodiment of the present invention.
Figure 2:
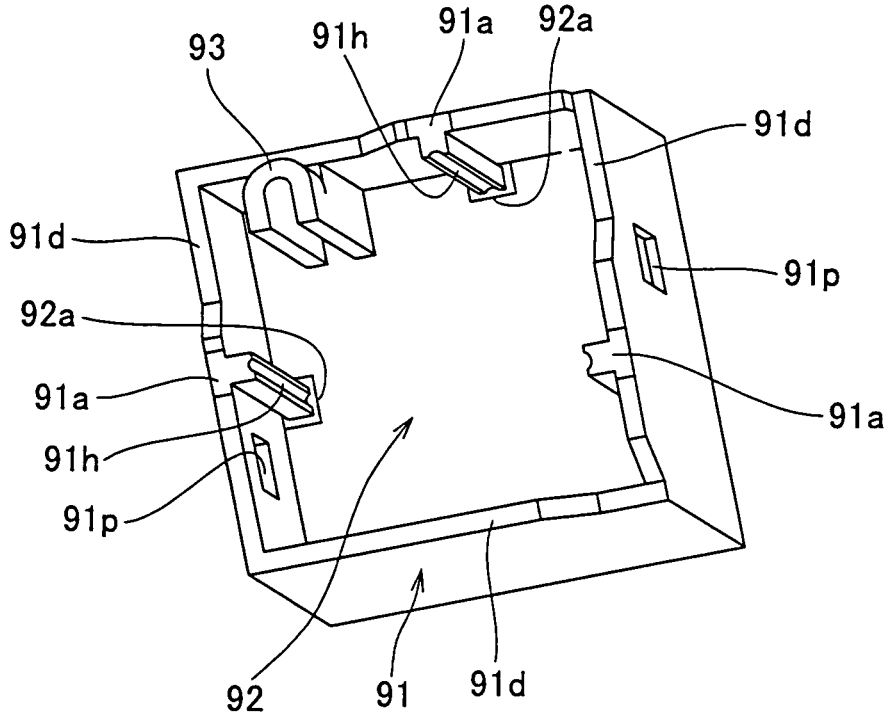
FIG. 2 is a perspective view of a knob of the FIG. 1 push type switch, as viewed obliquely from below.
Figure 3A:
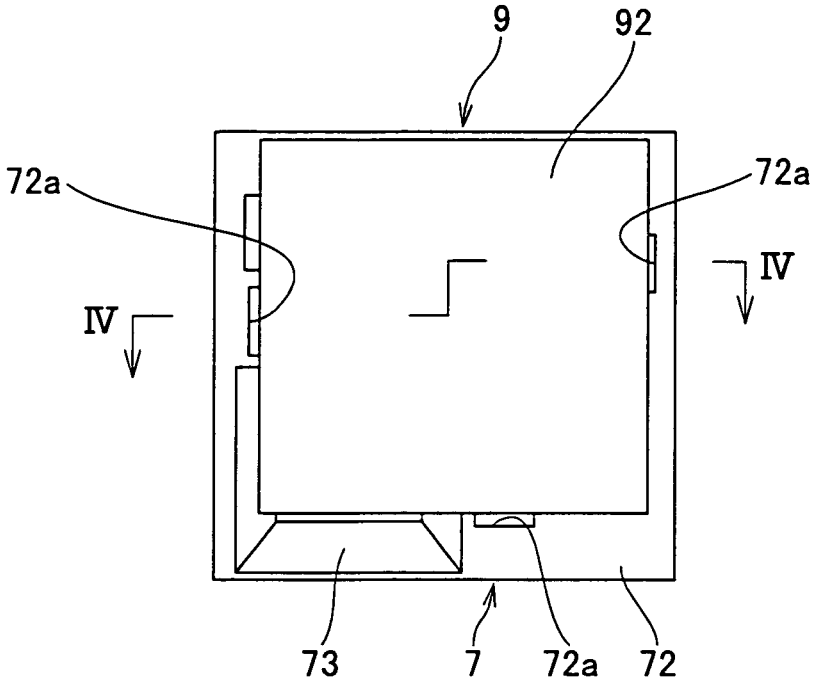
FIG. 3A is a front view of the FIG. 1 push type switch.
Figure 3B:
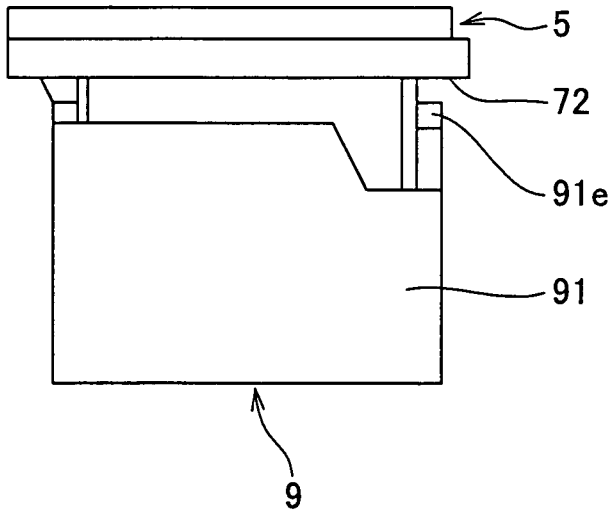
FIG. 3B is a plan view of the FIG. 1 push type switch.
Figure 3C:
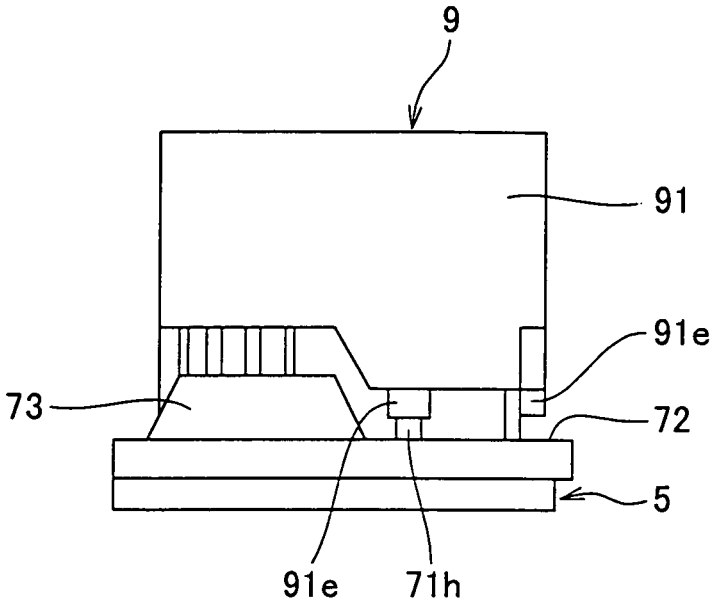
FIG. 3C is a bottom view of the FIG. 1 push type switch.
Figure 3D:
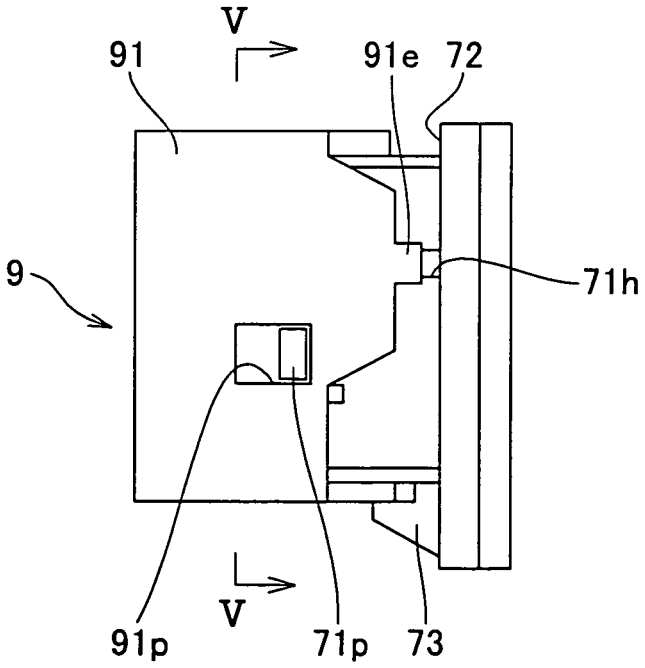
FIG. 3D is a right side view of the FIG. 1 push type switch.
Figure 4:
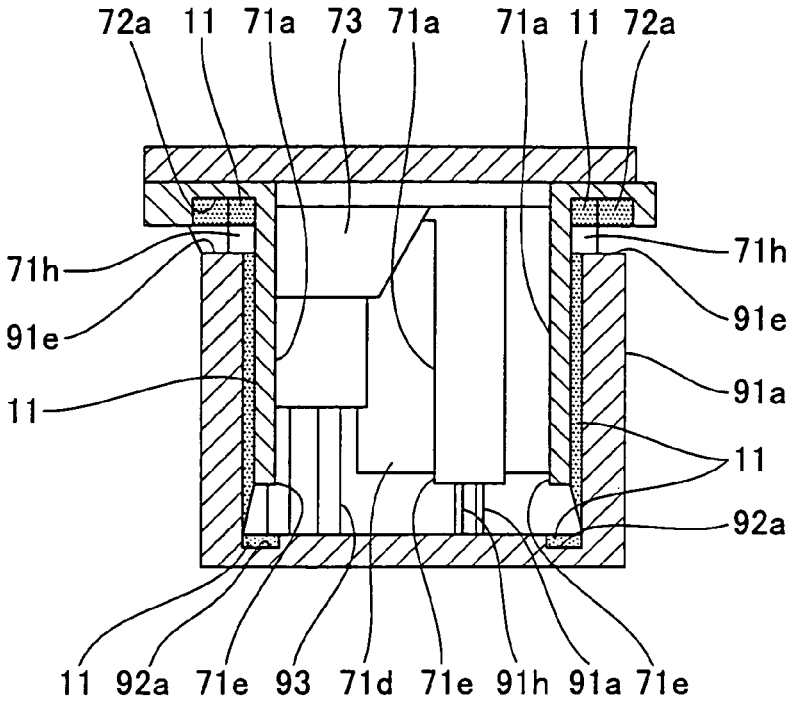
FIG. 4 is a cross-sectional view taken on line IV-IV of FIG. 3A.
Figure 5:
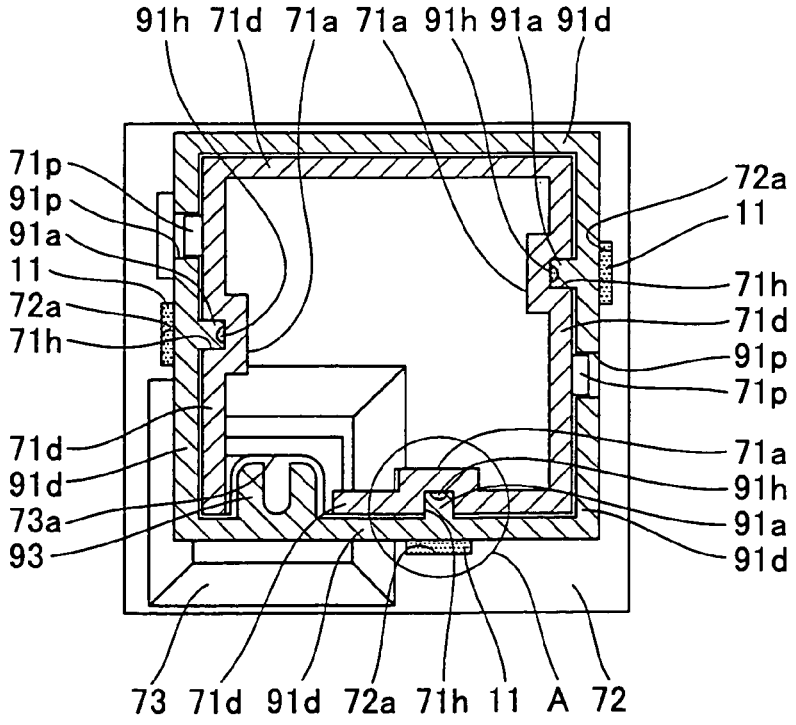
FIG. 5 is a cross-sectional view taken on line V-V of FIG. 3D.
Figure 6:
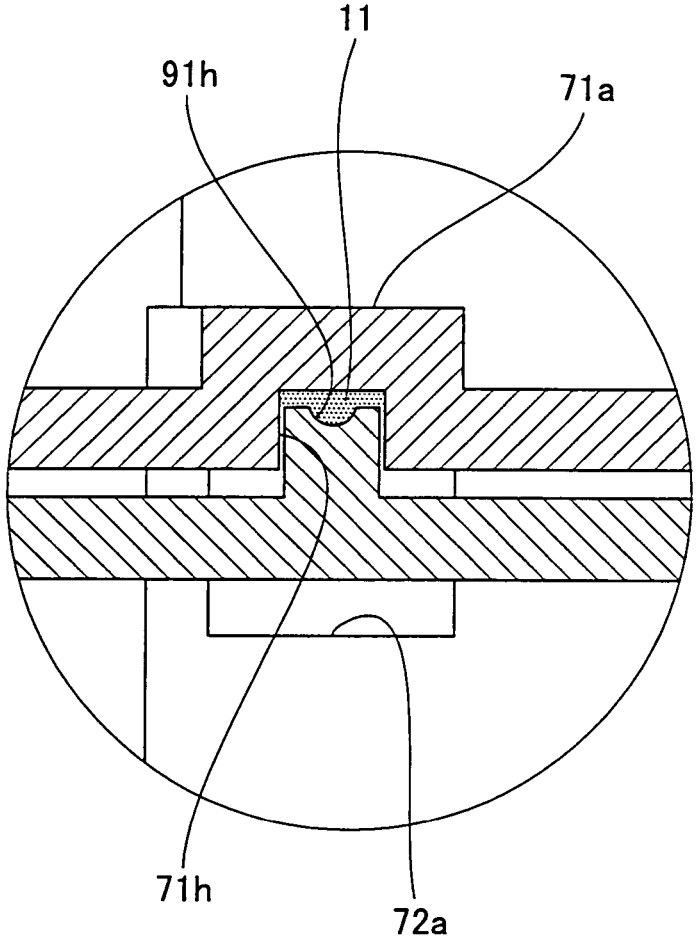
FIG. 6 is an enlarged view of part A appearing in FIG. 5.

FIG. 1 is an exploded perspective view of a push type switch according to a first embodiment of the present invention; FIG. 2 is a perspective view of a knob of the FIG. 1 push type switch, as viewed obliquely from below; FIG. 3A is a front view of the FIG. 1 push type switch; FIG. 3B is a plan view of the FIG. 1 push type switch; FIG. 3C is a bottom view of the FIG. 1 push type switch; FIG. 3D is a right side view of the FIG. 1 push type switch; FIG. 4 is a cross-sectional view taken on line IV-IV of FIG. 3A; FIG. 5 is a cross-sectional view taken on line V-V of FIG. 3D; and FIG. 6 is an enlarged view of part A appearing in FIG. 5.

As shown in FIGS. 1 to 6, the push type switch is comprised of a switch body 3, a printed wiring board 5, a casing 7, and a knob (movable member) 9.

The switch body 3 is disposed at a corner of the printed wiring board 5. The switch body 3 includes a click board 31, a pair of fixed contact points (not shown), and a movable contact point (not shown). The click board 31 is made of an elastic material having insulating properties such that it has a generally domed shape. The click board 31 has a protrusion 31*a* formed on the top thereof. The pair of fixed contact points are arranged on the printed wiring board 5, and covered by the click board 31. The movable contact point is disposed on an inner surface of the click board 31 in a manner opposed to the pair of fixed contact points.

The printed wiring board 5 is formed with a conductor pattern (not shown). Part of the conductor pattern is connected to the pair of fixed contact points.

The casing 7 is formed of resin as a unitary member, and includes a hollow section 71, a frame 72, and an accommodating section 73.

The hollow section 71 has a generally hollow prismatic shape, and includes three pillar-like portions 71*a*, and a plurality of plate-like portions 71*d* formed between the three pillar-like portions 71*a*. The pillar-like portions 71*a* extend along the direction of the height H1 (see FIG. 1) of the hollow section 71. The pillar-like portions 71*a* are larger in height than the plate-like portions 71*d*, and hence the upper ends of the pillar-like portions 71*a* protrude from the upper end faces of the plate-like portions 71*d*, and the protruding portions serve as grease supply protrusions 71*e* (see FIGS. 1 and 4). The pillar-like portions 71*a* each have an outer side surface formed with a guide groove 71*h* that extends along the direction of the height H1 of the hollow section 71. The grease supply protrusions 71*e* are formed with grease supply reservoirs (second grease reservoirs) 71*k*. The grease supply reservoirs 71*k* communicate with the guide grooves 71*h*, respectively, and extend in a manner widened toward the ends thereof.

The two plate-like portions 71*d* opposed to each other are formed with protrusions 71*p*, respectively. The protrusions 71*p* are generally wedge-shaped.

The frame 72 surrounds one end of the hollow section 71, and includes three grease supply reservoirs (second grease reservoirs) 72*a*. The grease supply reservoirs 72*a* communicate with the guide grooves 71*h*.

The accommodating section 73 is formed at a corner of the frame 72 in a manner such that a half thereof extends into the hollow section 71 (see FIG. 5). The top of the accommodating section 73 is formed with a hole 73*a*. The accommodating section 73 accommodates the switch body 3.

The above described printed wiring board 5 and the casing 7 constitute a fixing member having the switch body 3 fixed thereto.

The knob 9 is approximately box-shaped and formed of resin. The knob 9 has a skirt 91, a pushed portion 92, and a pushing portion 93.

The skirt 91 has a generally hollow prismatic shape, and includes three rails 91*a*, and a plurality of plate-like portions 91*d* formed between the three rails 91*a*. The rails 91*a* extend along the direction of the height H2 (see FIG. 1) of the knob 9. The rails 91*a* are larger in height than the plate-like portions 91*d*, so that the foremost ends of the rails 91*a* protrude from the end faces of the plate-like portions 91*d*, and the protruding portions serve as grease supply protrusions 91*e* (see FIG. 1). The rails 91*a* are formed with respective grease-holding grooves (first grease reservoirs) 91*h*. The grease-holding grooves 91*h* extend along the direction of the length of the rails 91*a*.

The rails 91*a* are slidably inserted into the associated guide grooves 71*h*. As described above, in the first embodiment, the guide groove 71*h* and the rails 91*a* constitute respective sliding portions.

The grease supply protrusions 91*e* enter the grease supply reservoirs 72*a*, when the knob 9 is closest to the frame 72.

Opposed two of the plate-like portions 91*d* are formed with holes 91*p*, respectively. The holes 91*p* are rectangular in shape and have the associated protrusions 71*p* received therein. In this state, the protrusions 91*p* can be relatively moved within a predetermined range. This range determines the stroke of the knob 9, which is thus prevented from falling off the casing 7.

The pushed portion 92 is for being pushed with a finger. The pushed portion 92 has a plate-like shape, and is connected to one end of the skirt 91. The pushed portion 92 has three grease supply reservoirs (second grease reservoirs) 92*a*. The three grease supply reservoirs 92*a* are formed in a manner surrounding the rails 91*a*, and communicate with the grease-holding grooves 91*h*. The grease supply reservoirs 92*a* receive the grease supply protrusions 71*e*, when the knob 9 is closest to the frame 72.

The pushing portion 93 is disposed at a corner of the pushed portion 92, and connected to the skirt 91. The foremost end of the pushing portion 93 is inserted into the accommodating section 73 via the hole 73*a*. The pushing portion 93 pushes the protrusion 31*a* of the click board 31.

Grease 11 is applied to the guide grooves 71*h* and the rails 91*a* (see FIG. 6). As the grease 11, there is used a fluorine-based grease the viscosity of which is within a range of 1000 to 2750 Pa.

It should be noted that the viscosity of the grease 11 is expressed in terms of torque. The torque is defined here as a shearing force (in units of Pa) obtained when 0.2 cc of the grease is placed on a plate of a rotation viscometer, and the plate is rotated at a rotational speed of 10 rpm.

Figure 7:
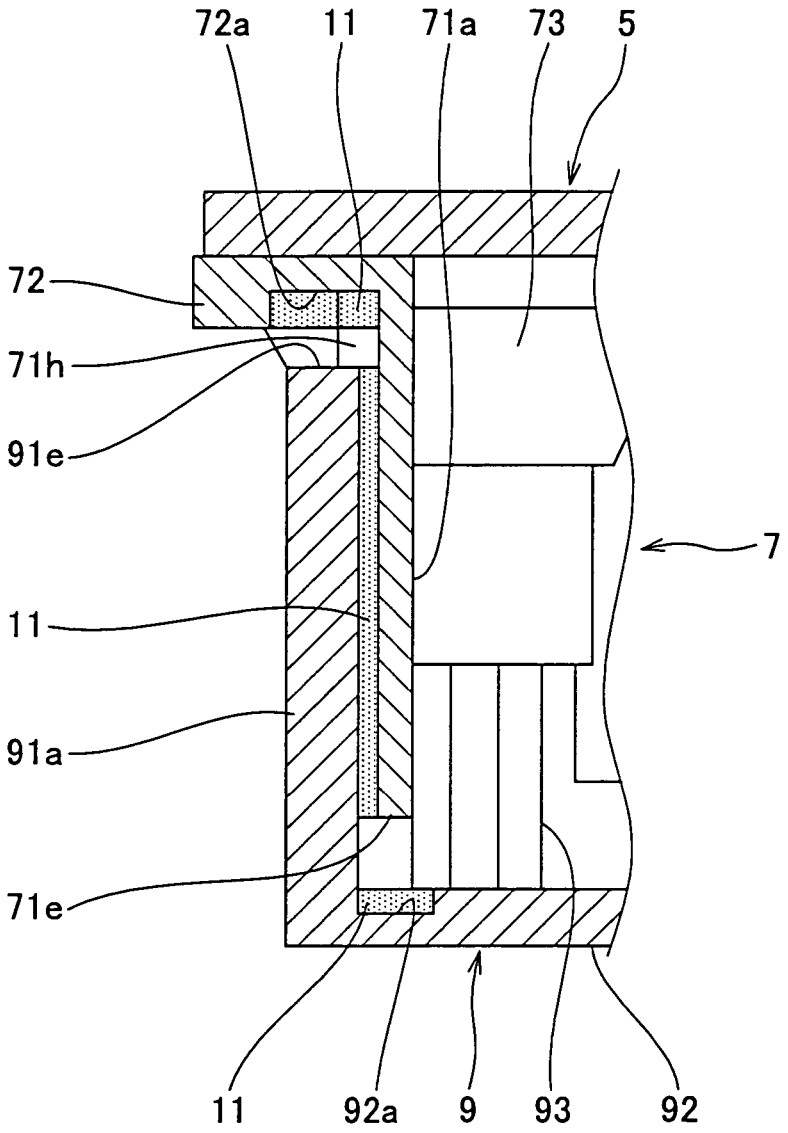
FIG. 7 is a cross-sectional view taken on the same line as in FIG. 4, in a state where the knob is not pushed.
Figure 8:
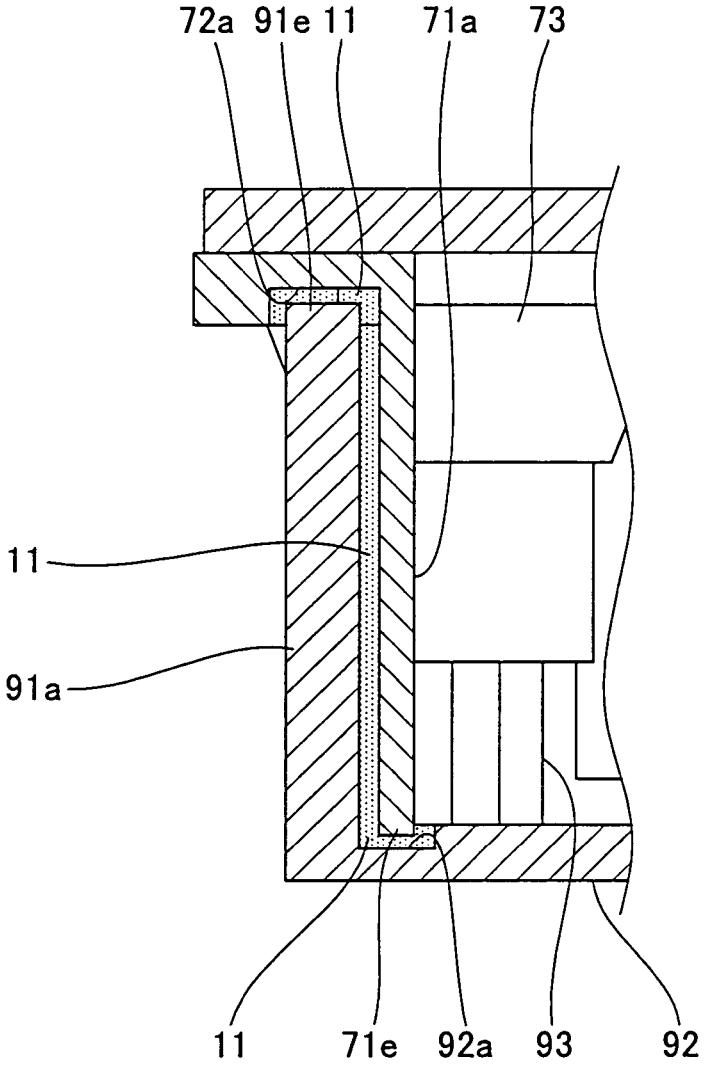
FIG. 8 is a cross-sectional view taken on the same line as in FIG. 4, in a state where the knob is pushed.

FIG. 7 is a cross-sectional view taken on the same line as in FIG. 4, in a state where the knob is not pushed, and FIG. 8 is a cross-sectional view taken on the same line as in FIG. 4, in a state where the knob is pushed.

Next, a description will be given of the operation of the push type switch according to the present embodiment.

In a state where the operator is not pushing the knob 9 with his finger (the state shown in FIG. 7), the knob 9 is urged by the resilience of the click board 31 via the protrusion 31*a*, whereby the knob 9 is at a position away from the printed wiring board 5.

When the operator pushes the knob 9 with his finger against the resilience of the click board 31, the pushing force is transmitted to the click board 31 via the pushing portion 93 and the protrusion 31*a*, whereby the click board 31 is progressively crushed. When the pushing force applied to the click board 31 exceeds a predetermined value, the click board 31 is inverted in shape, i.e. changed from a convex state into a concave state, as shown in FIG. 8. At this time, a click feeling is obtained, and the movable contact point is brought into contact with the pair of fixed contact points, whereby the switch body 3 is turned on.

When the operator releases his finger from the knob 9, the knob 9 is returned to its original position by the resilience of the click board 31, and the movable contact point is moved away from the pair of fixed contact points, whereby the switch body 3 is turned off.

Next, a description will be given of the circulation of the grease 11.

In the state where the operator is not pushing the knob 9 with his finger, the knob 9 is spaced away from the printed wiring board 5 by the click board 31, as described above. In this state, the grease supply protrusions 71*e* and 91*e* are away from the grease supply reservoirs 92*a* and 72*a*, respectively.

When the knob 9 is pushed to be moved toward the printed wiring board 5, the grease 11 hardly leaks from the guide grooves 71*h* since the grease 11 within the guide grooves 71*h* is held by the grease-holding grooves 91*h*. When the switch body 3 is turned on, a small amount of the grease 11 is discharged from the guide grooves 71*h*. However, the grease 11 discharged from the guide grooves 71*h* is stored in the grease supply reservoirs 72*a* and 92*a*, as shown in FIG. 8. Further, at this time, the grease supply protrusions 71*e* and 91*e* are inserted into the grease supply reservoirs 92*a* and 72*a*, respectively, and the grease 11 stored in the grease supply reservoirs 72*a* and 92*a* is attached to the grease supply protrusions 71*e* and 91*e*.

When the finger is released from the knob 9 to allow the knob 9 to be returned to its original position by the resilience of the click board 31, the grease 11 attached to the grease supply protrusions 71*e* and 91*e* returns to the guide grooves 71*h*. This reduces the loss of the grease 11 to a very small amount.

Next, a description will be given of an operation feeling produced by operating the knob 9.

During a time period from the start of pushing of the knob 9 by the operator to the switch-on of the switch body 3, the rails 91*a* slide within the guide grooves 71*h*. At this time, since the grease 11 having a high viscosity exists between the rails 91*a* and the guide grooves 71*h*, the rails 91*a* are moved slowly, and what is more, generation of noise, such as rattling or sliding noise of the knob 9, is suppressed. Thus, the operator feels an appropriate resistance on his fingertip when pressing the knob 9, and the knob 9 moves quietly and slowly without rattling. As a result, the operator can obtain an upscale impression of the push type switch. Further, also when the click board 31 is inverted in shape, the grease 11 having a high viscosity softens the click feeling, which enhances the upscale impression.

Next, a description will be given of the effects of the present embodiment.

According to the push type switch, the grease 11 having a viscosity within the range of 1000 to 2750 Pa is used. Therefore, when the operator pushes the knob 9, an appropriate pressure acts on a finger of the operator, and the knob 9 moves quietly and slowly with little rattling. As a result, the operator can obtain an upscale impression of the push type switch.

Further, since the grease 11 is a fluorine-based grease, no significant change in the viscosity is caused by temperature, which makes it possible to prevent the operation feeling from being changed due to changes in temperature.

Furthermore, since the grease-holding grooves 91*h*, the grease supply reservoirs 72*a* and 92*a*, and the grease supply protrusions 71*e* and 91*e* are employed, the loss of the grease 11 is small even after the push type switch is used for a long time period. This makes it possible to maintain the upscale impression of the push type switch for a long time period.

It should be noted that although in the present embodiment, the fluorine-based grease is used as the grease 11, this is not limitative, but an olefin-based grease, for example, may be employed as the grease 11.

Further, although in the present embodiment, the grease-holding grooves 91*h* are formed in the rails 91*a*, it is not necessarily required to form the grease-holding grooves 91*h* in the rails 91*a*.

It should be noted that although the grease supply protrusions 71*e* and the grease supply reservoirs 72*a* are formed in the casing 7, and the grease supply protrusions 91*e* and the grease supply reservoirs 92*a* are formed in the knob 9, it is not necessarily required to provide the grease supply protrusions 71*e* and 91*e*, or the grease supply reservoirs 72*a* and 92*a*.

Further, although in the present embodiment, the guide grooves 71*h* are formed in the casing 7, and the rails 91*a* are provided in the knob 9, this is not limitative, but the guide grooves may be formed in the knob 9 and the rails may be provided in the casing 7.

It should be noted that the number of the guide grooves 71*h* and that of the rails 91*a* are not limited to three.

Next, a description will be given of a test performed for defining a range of viscosity of grease producing the upscale impression of the push type switch during operation thereof.

Table 1 indicates samples and viscosities of greases employed in the test.

TABLE 1

Samples Used in Evaluation Test

| Sample Name | Viscosity of Grease (torque: Pa) |
|---|---|
| Sample A | 0 (No grease) |
| Sample B | 220 |
| Sample C | 750 |
| Sample D | 1230 |
| Sample E | 1930 |
| Sample F | 2500 |
| Sample G | 4000 |

Figures 9, 10:
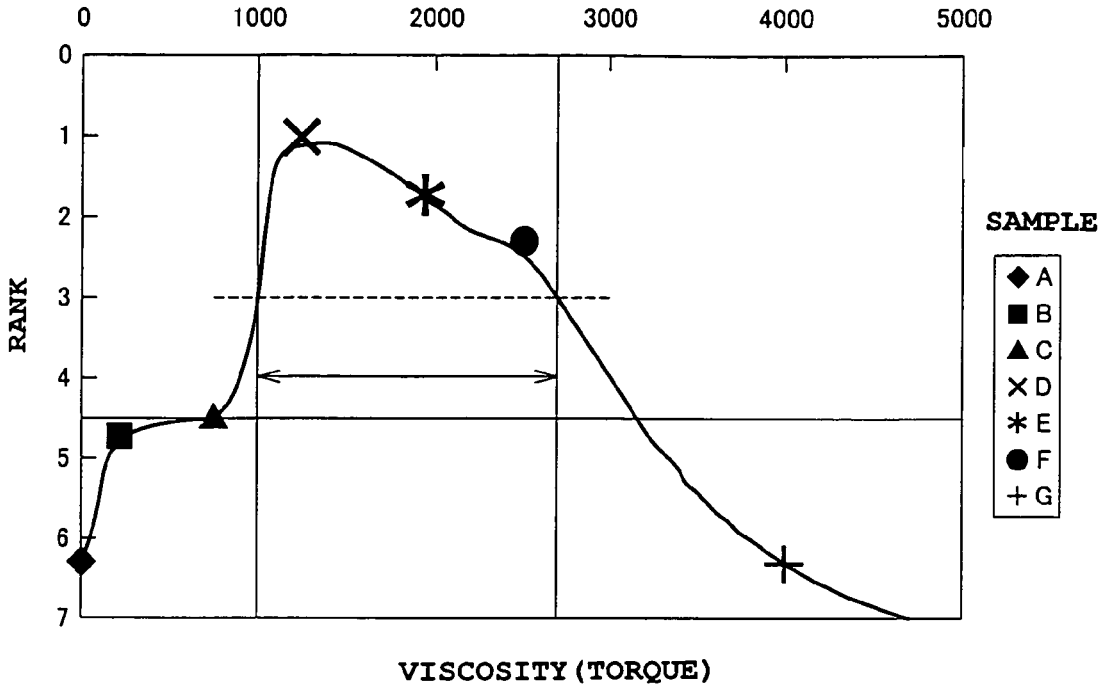
FIG. 9 is a graph showing the relationship between the average ranks of samples and the viscosities of greases.
FIG. 10 is a view showing a table of evaluation items and evaluation scores of the samples on a seven-point scale.
Figure 11:
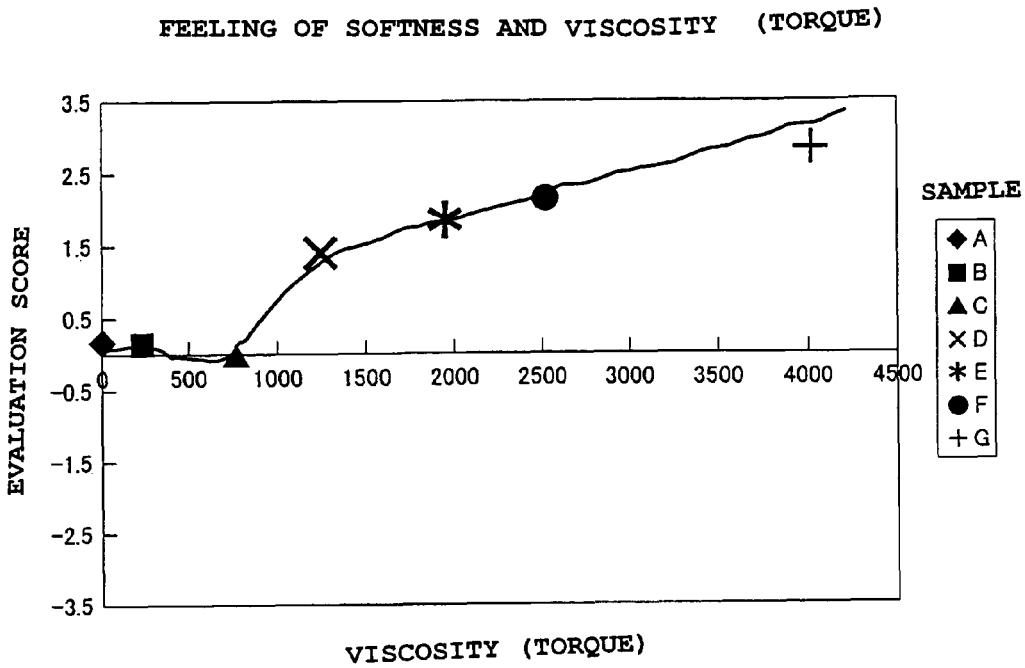
FIG. 11 is a graph showing the relationship between the average evaluation scores of the respective samples as to the feeling of softness obtained during operation of the knob and the viscosities of the greases.
Figure 12:
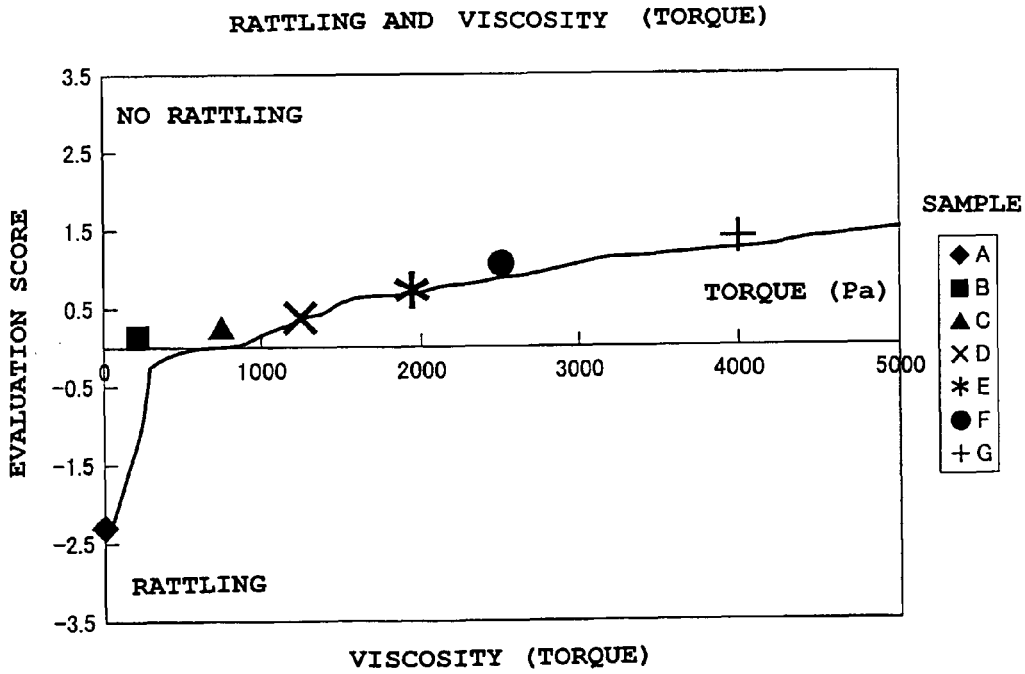
FIG. 12 is a graph showing the relationship between the average evaluation scores of the respective samples as to rattling of the knob and the viscosities of the greases.
Figure 13:
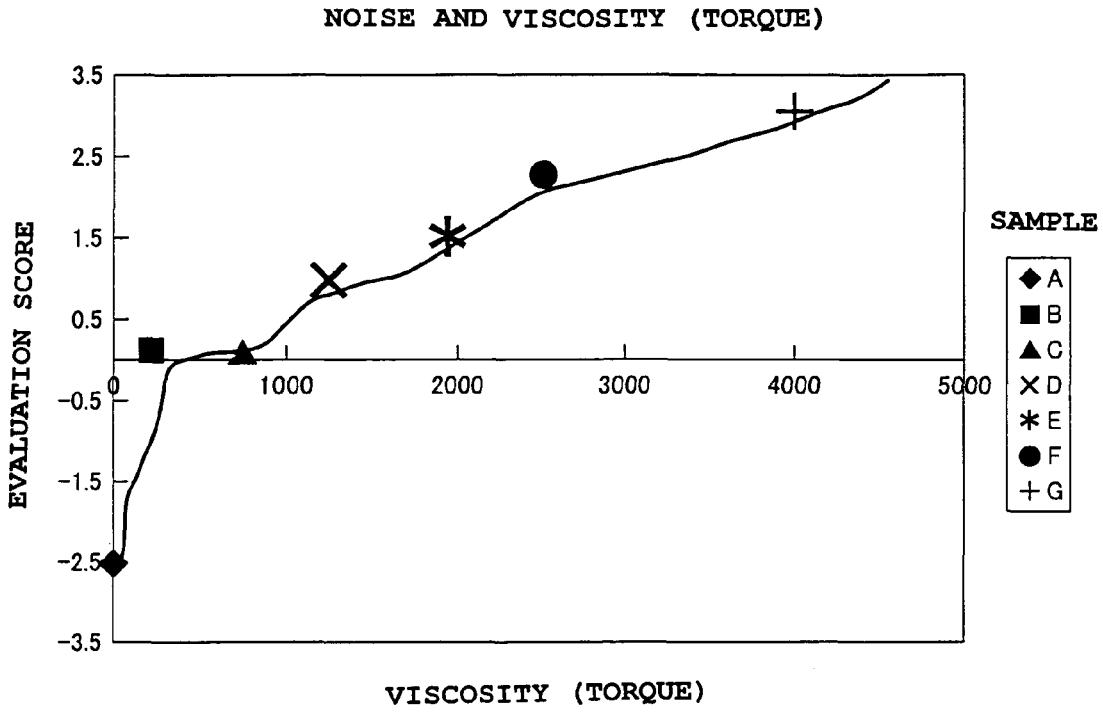
FIG. 13 is a graph showing the relationship between the average evaluation scores of the respective samples as to generation of noise during the operation of the knob and the viscosities of the greases.

FIG. 9 is a graph showing the relationship between the average ranks of samples and the viscosities of greases; FIG. 10 is a view showing a table of evaluation items and evaluation scores of the samples on a seven-point (−3 to 3-point) scale; FIG. 11 is a graph showing the relationship between the average evaluation scores of the respective samples as to the feeling of softness obtained during operation of the knob and the viscosities of the greases; FIG. 12 is a graph showing the relationship between the average evaluation scores of the respective samples as to rattling of the knob and the viscosities of the greases; and FIG. 13 is a graph showing the relationship between the average evaluation scores of the respective samples as to generation of noise during the operation of the knob and the viscosities of the greases.

As shown in Table 1, a push type switch which has no grease applied to sliding portions (the guide grooves 71*h* and the rails 91*a*) is referred to as Sample A. Push type switches which have greases having different viscosities applied to sliding portions thereof are referred to as Sample B to Sample G, respectively. The viscosities of the greases used in the respective samples are shown in Table 1.

Then, a plurality of monitors were caused to operate Samples A to G, and the ranks or places of Samples A to G in the respective ranks orders as to the relative merits and demerits thereof concerning the operation feeling, rattling, and noise were determined on a sample-by-sample basis, and the averages of the ranks or places of each of Samples A to G in the rank orders were obtained. The results are shown in FIG. 9.

The monitors felt upscale impressions from samples of a third place or higher in the average rank order. The viscosities of the greases used in the samples of the third place or higher are within a range of 1000 Pa to 2750 Pa.

Then, Samples A to G were evaluated as to the feeling of softness (feeling of resistance), the rattling of the knob, and the generation of noise during the operation of the knob. To express results of evaluation in numerical points, as shown in FIG. 10, evaluations concerning each item were classified into seven levels in which positive evaluations are assigned scores of 3, 2, and 1 in decreasing order of the evaluations, whereas negative evaluations are assigned scores of −1, −2, and −3 in decreasing order of the evaluations. Further, when neither of the positive evaluations and the negative evaluations can be given, an evaluation score of 0 was imparted.

The monitors evaluated Samples A to G as to each item of evaluation. The relationship between the respective average evaluation scores of Samples A to G concerning the feeling of softness and the viscosities of the greases is shown in FIG. 11; the relationship between the respective average evaluation scores of Samples A to G concerning the rattling of the knob and the viscosities of the greases is shown in FIG. 12; and the relationship between the respective average evaluation scores of Samples A to G concerning noise and the viscosities of the greases is shown in FIG. 13.

As shown in FIG. 11, the average evaluation score concerning the feeling of softness is higher as the viscosity of the grease is higher. However, the feeling of softness and the upscale impression of the push type switch during operation thereof do not coincide with each other. When the viscosity is larger than 2500 Pa, the feeling of softness becomes excessive, and most of the monitors felt extreme reduction in the feeling of input operation (feeling of pushing in the push type switch).

Referring to FIG. 12 and FIG. 13, however, the average evaluation scores concerning the rattling of the knob and the generation of noise are higher as the viscosity of the grease is higher, and hence the total evaluation makes it possible to obtain the upscale impression even after the viscosity of the grease exceeds 2500 Pa. Therefore, as shown in FIG. 9, the range of the viscosity of the grease where the upscale impression can be obtained was determined to be 1000 to 2750 Pa.

Figure 14:
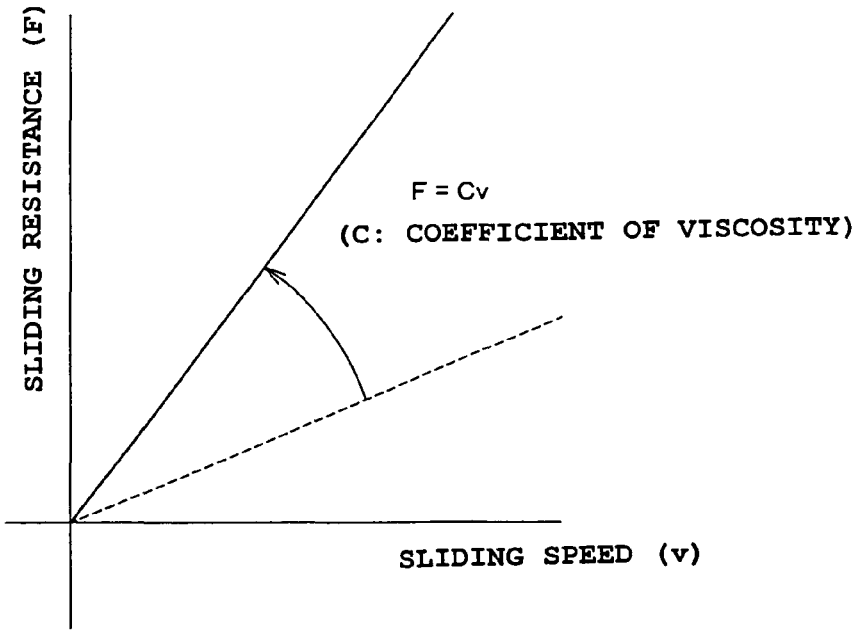
FIG. 14 is a graph showing the relationship between the sliding speed and the sliding resistance of the knob exhibited when a low-viscosity grease is used or when a high-viscosity grease is used.

FIG. 14 is a graph showing the relationship between the sliding speed and the sliding resistance of the knob exhibited when a low-viscosity grease is used or when a high-viscosity grease is used.

Referring to FIG. 14, in the case where the low-viscosity grease is used (Sample B), which is indicated by a dotted line, the sliding resistance F of the knob 9 does not become so large even when the sliding speed v of the knob 9 becomes higher. On the other hand, in the case where the high-viscosity grease is used (Sample D), which is indicated by a solid line, when the sliding speed v of the knob 9 becomes higher, the sliding resistance F of the knob 9 increases at a higher rate than the rate of increase in the sliding speed v.

Assuming that the coefficient of viscosity of a grease is represented by C, and the sliding speed of the knob by v, the sliding resistance F of the knob 9 can be obtained by the following equation:

$$F=Cv$$

As described above, if the high-viscosity grease is used, the sliding resistance F of the knob 9 increases at a higher rate than the rate of the increase in the sliding speed v, so that a sharp change in load on the knob 9 is alleviated. This action mainly leads to enhancement of the operation feeling produced when the click board 31 is inverted in shape.

Based on the results of the test described above, the range of the viscosity of the grease 11 was determined to be 1000 to 2750 Pa.

Figure 15:
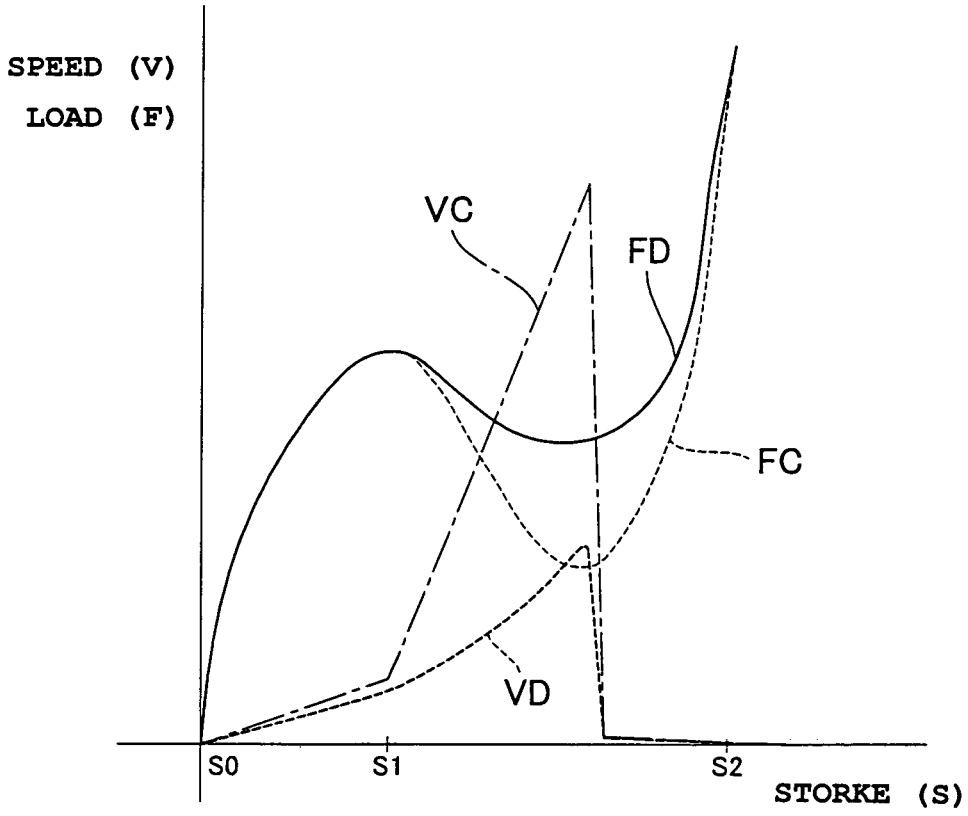
FIG. 15 is a graph in which the horizontal axis represents the stroke of the knob, and the vertical axis represents the speed of the knob and the load on the knob.

Since it is difficult to describe the difference between the operation feeling of Sample C and that of Sample D, the difference is represented by a graph shown in FIG. 15.

In FIG. 15, the horizontal axis represents the stroke of the knob, and the vertical axis represents the speed of the knob and the load on the knob.

For purposes of ease of comparison between the operation feeling of Sample C and that of Sample D, the pushing force applied to the knob 9 during a time period from the start of pushing the knob 9 to the inversion of the click board 31 (between strokes S0 and S1) was set to be equal between Sample C and Sample D.

A curve VC represents the relationship between the stroke (S) and the speed (V) of a knob 9 of Sample C, a curve VD represents the relationship between the stroke (S) and the speed (V) of a knob 9 of Sample D, a curve FC represents the relationship between the stroke (S) and load (F) on the knob 9 of Sample C, and a curve FD represents the relationship between the stroke (S) and load (F) on the knob 9 of Sample D.

As shown in FIG. 15, between the strokes S0 and S1, the knob 9 of Sample D moves a little more slowly than the knob 9 of Sample C.

During a time period from the inversion of the click board 31 to the stop of the knob 9 (between strokes S1 and S2), both the speed (V) and the load (F) sharply change in Sample C, whereas in Sample D, both the speed (V) and the load (F) change more slowly than in Sample C. This means that in Sample C, the click feeling is sharpened, whereas in Sample D, the click feeling is softened.

As described above, the slower motion and the softer click feeling of the knob 9 give the upscale operation feeling thereto.

Next, a description will be given of variations of the first embodiment.

Figure 16:
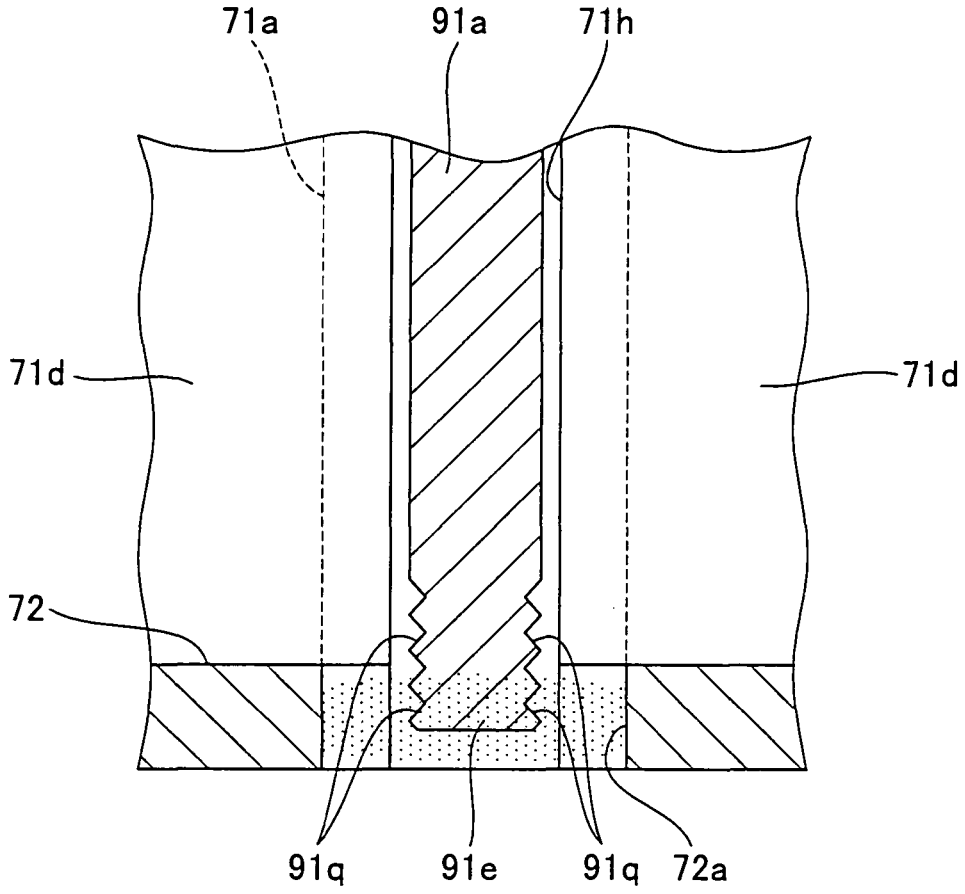
FIG. 16 is a cross-sectional view showing a sliding portion of a first variation of the first embodiment.

FIG. 16 is a cross-sectional view showing a sliding portion of a first variation of the first embodiment.

As shown in FIG. 16, in the first variation, each grease supply protrusion 91*e* has a side surface formed with a plurality of grooves 91*q*.

In the first variation, the grease 11 becomes easier to be attached to the grease supply protrusions 91*e* due to the grooves 91*q*. As a result, it is possible to enhance the circulation of the grease 11.

Figure 17:
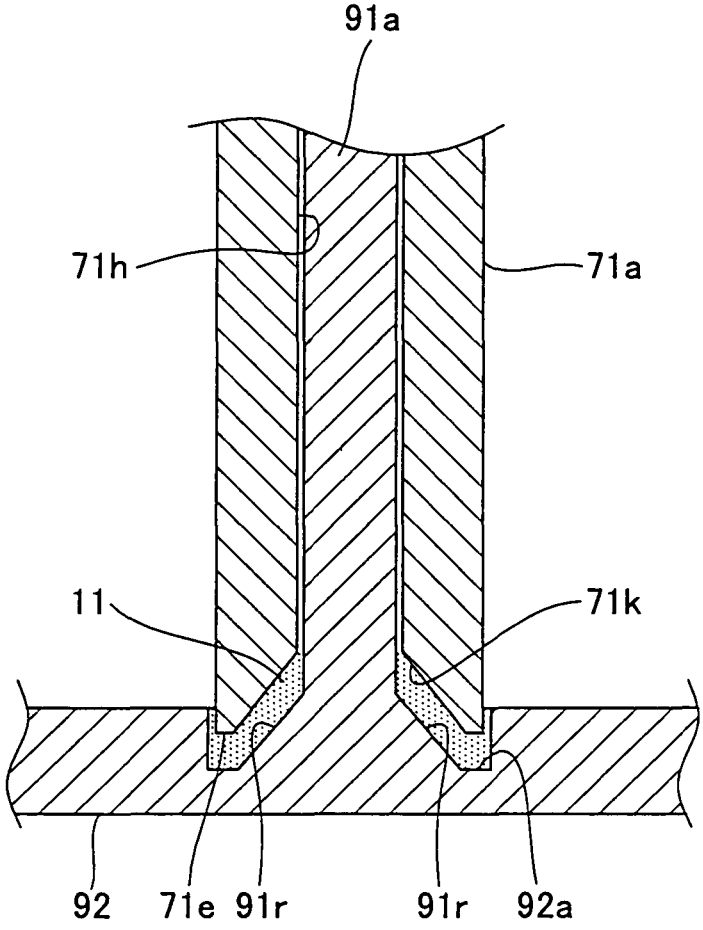
FIG. 17 is a cross-sectional view showing a sliding portion of a second variation of the first embodiment.

FIG. 17 is a cross-sectional view showing a sliding portion of a second variation of the first embodiment.

As shown in FIG. 17, in the second variation, a portion of each rail 91*a* accommodated in the associated grease supply reservoir 92*a* is formed with inflated portions 91*r*. The inflated portions 91*r* are configured to have a shape to be fitted in the grease supply reservoir 71*k*. When the grease supply protrusions 71*e* are inserted into the grease supply reservoirs 92*a*, the inflated portions 91*r* return the grease 11 within the grease supply reservoirs 71*k* to the guide grooves 71*h*.

In the second variation, since the grease 11 within the grease supply reservoirs 71*k* can be returned to the guide grooves 71*h* by the inflated portions 91*r*, it is possible to enhance the circulation of the grease 11, similarly to the first variation.

Figure 18:
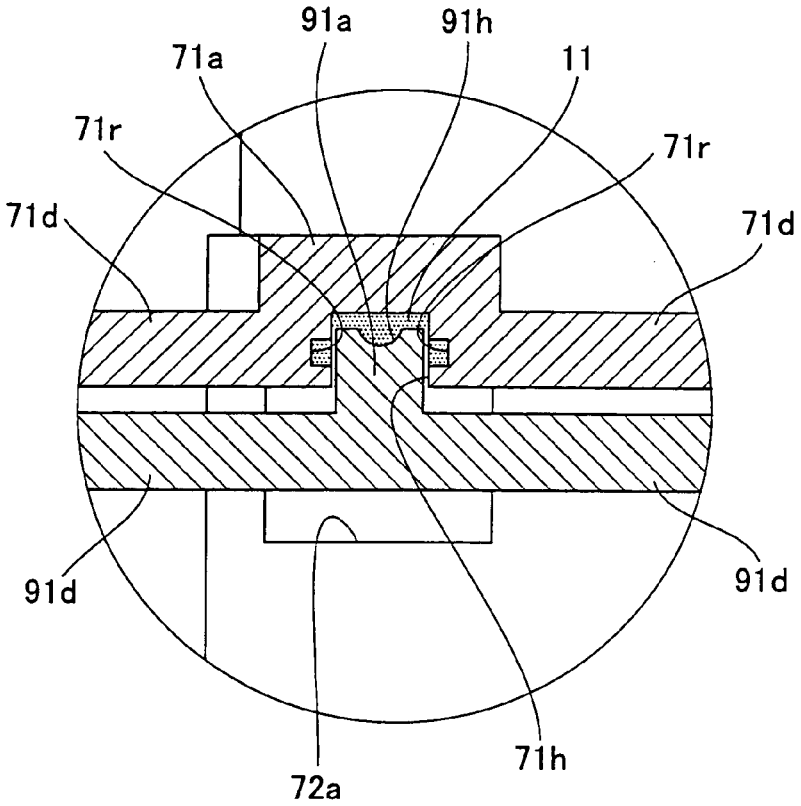
FIG. 18 is an enlarged cross-sectional view of part A of a third variation of the first embodiment.

FIG. 18 is an enlarged cross-sectional view showing part A of a third variation of the first embodiment.

As shown in FIG. 18, in the third variation, grease-holding grooves 71*r* are formed in respective opposed inner surfaces of each guide groove 71*h*. The grease-holding grooves 71*r* extend in parallel with the guide groove 71*h*.

In the third variation, since the grease-holding grooves 71*r* are formed in addition to the grease-holding grooves 91*h*, it is possible to further reduce the loss of the grease 11.

Figure 19:
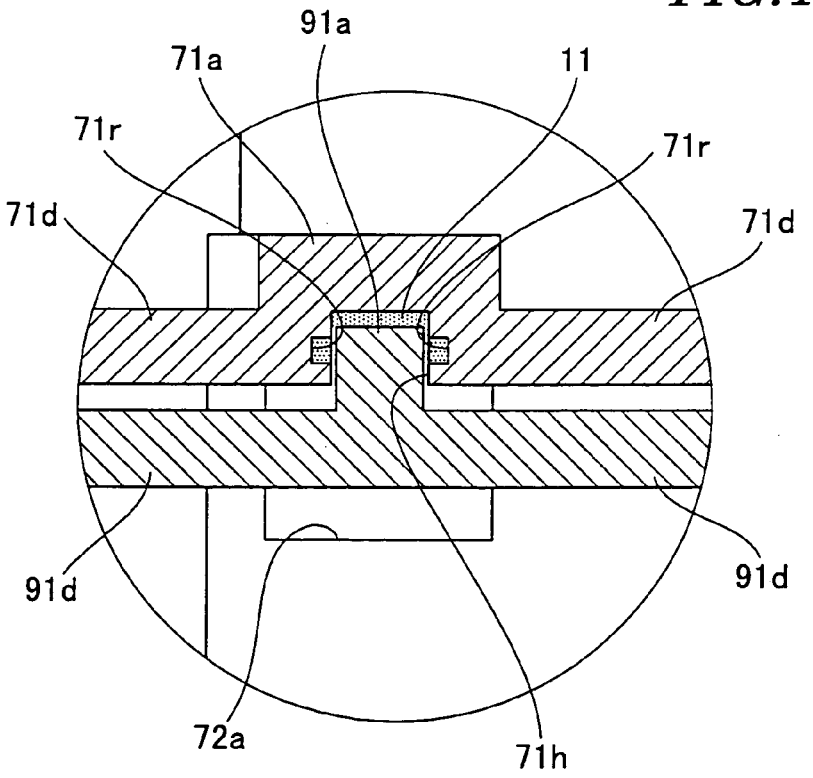
FIG. 19 is an enlarged cross-sectional view of part A of a fourth variation of the first embodiment.

FIG. 19 is an enlarged cross-sectional view showing part A of a fourth variation of the first embodiment.

As shown in FIG. 19, in the fourth variation, grease-holding grooves 71*r* are formed in respective opposed inner surfaces of each guide groove 71*h*, and the grease-holding groove 91*h* is eliminated from the top surface of each rail 91*a* (surface opposed to the bottom surface of each guide groove 71*h*).

The fourth variation provides the same advantageous effects as provided by the first embodiment shown in FIG. 1.

Figure 20:
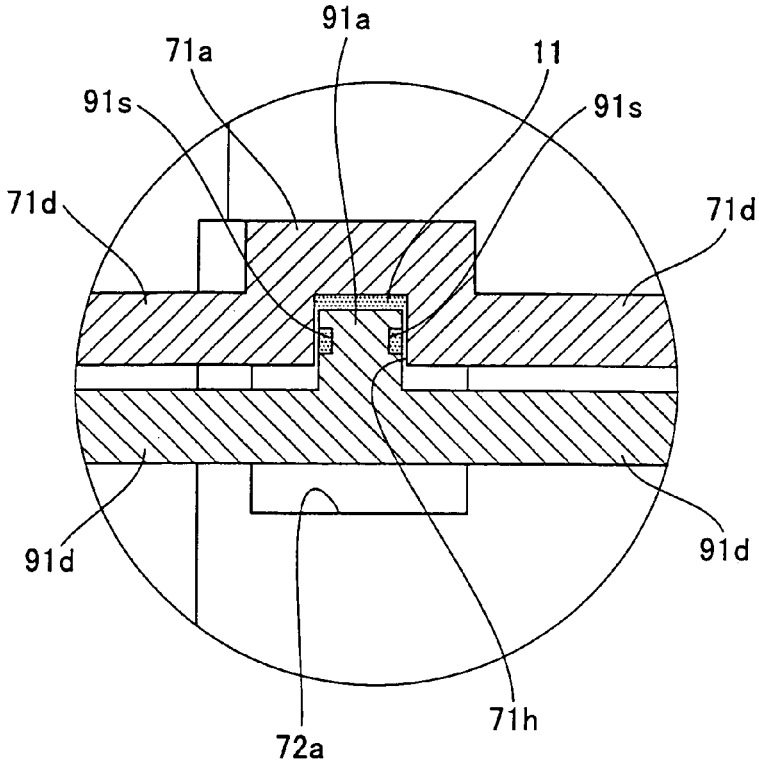
FIG. 20 is an enlarged cross-sectional view of part A of a fifth variation of the first embodiment.

FIG. 20 is an enlarged cross-sectional view showing part A of a fifth variation of the first embodiment.

As shown in FIG. 20, in the fifth variation, grease-holding grooves 91*s* are formed in respective opposite side surfaces of each rail 91*a*, and the grease-holding groove 91*h* is eliminated from the rail 91*a*.

The fifth variation provides the same advantageous effects as provided by the first embodiment shown in FIG. 1.

Figure 21:
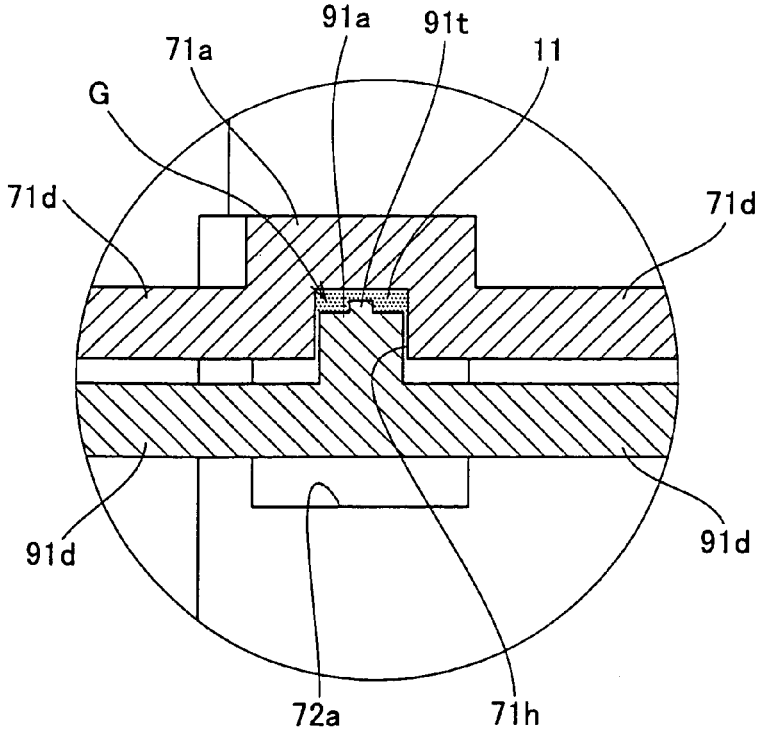
FIG. 21 is an enlarged cross-sectional view of part A of a sixth variation of the first embodiment.

FIG. 21 is an enlarged cross-sectional view showing part A of a sixth variation of the first embodiment.

As shown in FIG. 21, in the sixth variation, a key 91*t* is formed instead of forming the grease-holding groove 91*h* in the top surface of each rail 91*a* (surface opposed to the bottom surface of each guide groove 71*h*). The key 91*t* creates a gap G for holding the grease 11 between the top surface of the rail 91*a* and the guide groove 71*h*.

The sixth variation provides the same advantageous effects as provided by the first embodiment shown in FIG. 1.

Figure 22:
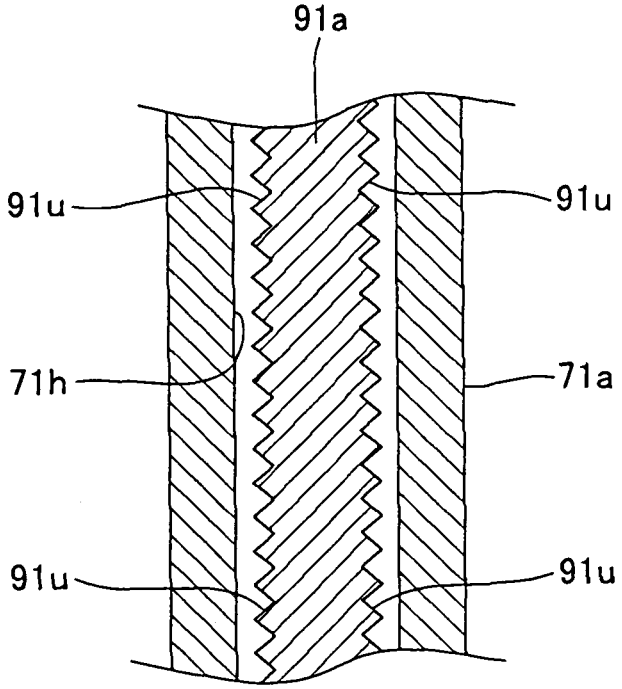
FIG. 22 is a cross-sectional view of a sliding portion of a seventh variation of the first embodiment.

FIG. 22 is a cross-sectional view showing a sliding portion of a seventh variation of the first embodiment.

As shown in FIG. 22, in the seventh variation, a plurality of grease-holding grooves 91*u* are formed in the opposite side surfaces of each rail 91*a*, instead of forming the grease-holding groove 91*h* in the top surface of the rail 91*a*. The grease-holding grooves 91*u* extend in a direction orthogonal to the direction of the length of the rail 91*a*.

The seventh variation provides the same advantageous effects as provided by the first embodiment shown in FIG. 1.

Figure 23:
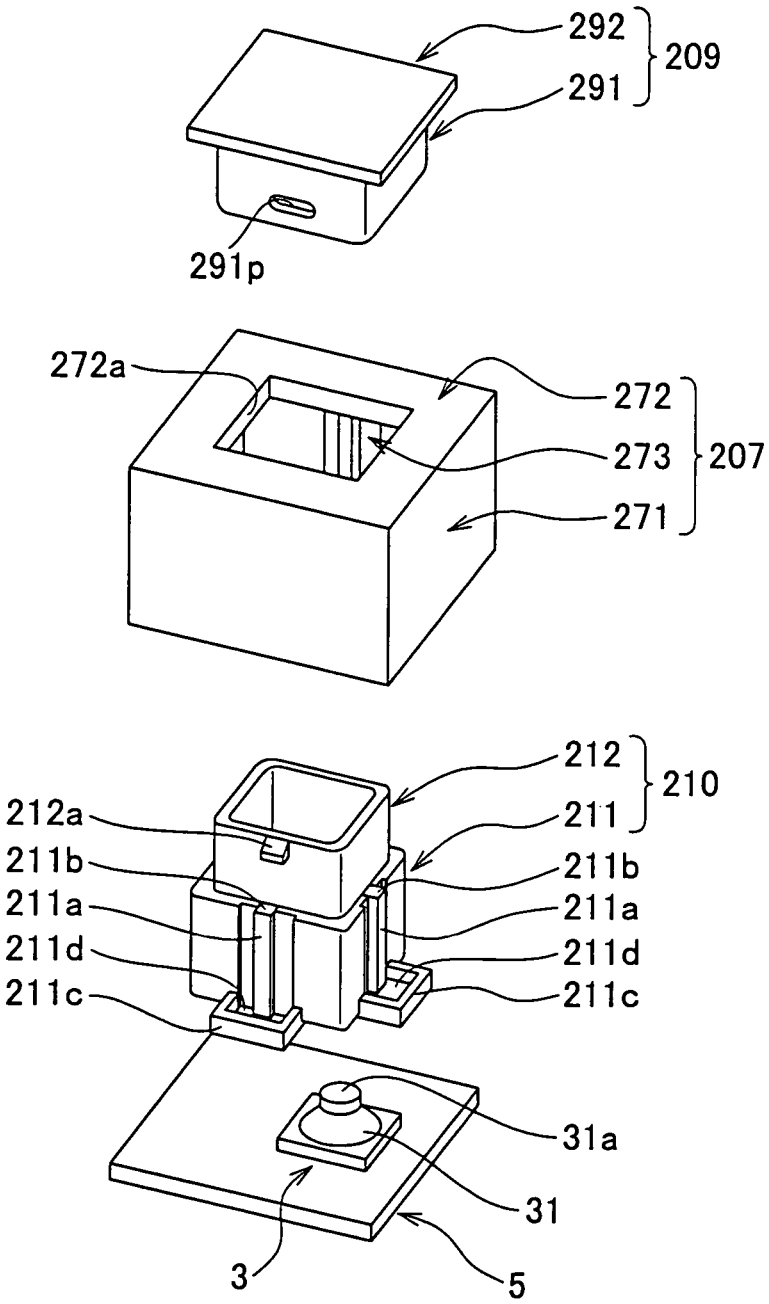
FIG. 23 is an exploded perspective view of a push type switch according to a second embodiment of the present invention.
Figure 24:
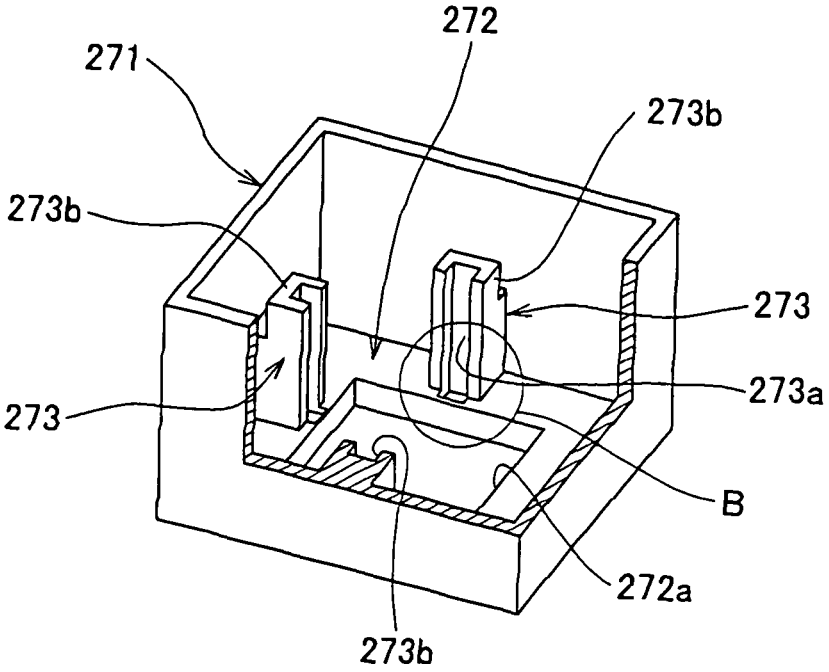
FIG. 24 is a perspective view of the FIG. 23 push type switch, in a state having part of a casing thereof cut off, and presented in an inverted position.
Figure 25:
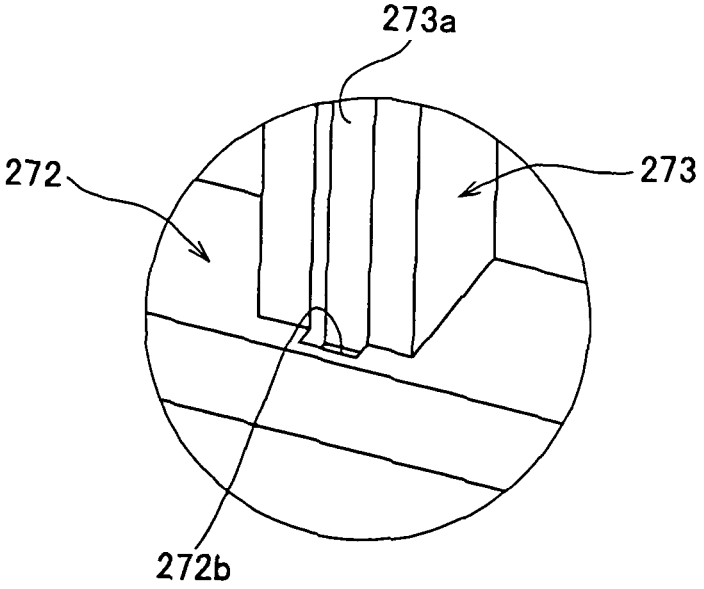
FIG. 25 is an enlarged view of part B appearing in FIG. 24.
Figure 26:
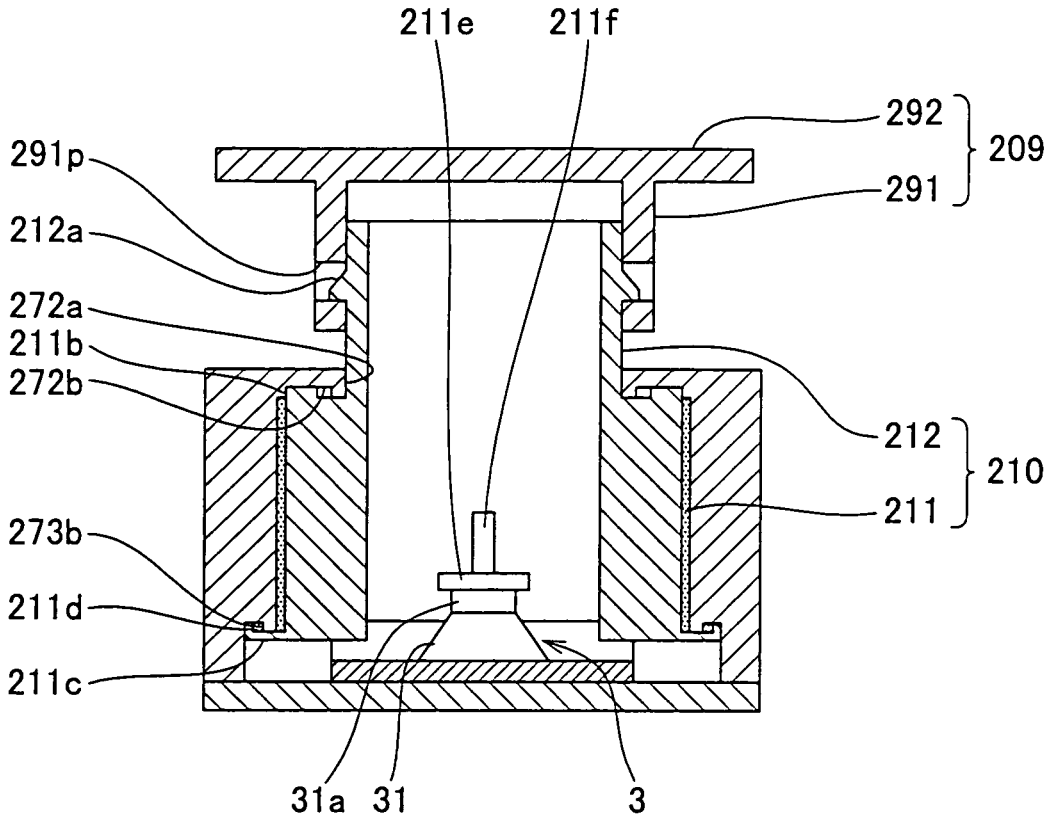
FIG. 26 is a cross-sectional view of the FIG. 23 push type switch.

FIG. 23 is an exploded perspective view of a push type switch according to a second embodiment of the present invention; FIG. 24 is a perspective view of the FIG. 23 push type switch, in a state having part of a casing thereof cut off, and presented in an inverted position; FIG. 25 is an enlarged view of part B appearing in FIG. 24; and FIG. 26 is a cross-sectional view of the FIG. 23 push type switch.

Component parts identical to those of the first embodiment are designated by identical reference numerals, and detailed description thereof is omitted, while only component parts different in configuration from the first embodiment will be described hereinafter.

As shown in FIGS. 23 to 26, the push type switch is comprised of a switch body 3, a printed wiring board 5, a casing 207, a knob 209, and a slider 210.

As distinct from the first embodiment in which the movable member is formed by the knob 9 alone, in the second embodiment, a movable member is formed by the knob 209 and the slider 210.

The casing 207 includes a hollow section 271, a lid 272, and pillar-like portions 273. The casing 207 contains the slider 210, and is rigidly fixed to the printed wiring board 5. The hollow section 271 has a hollow prismatic shape. The lid 272 is connected to one end of the hollow section 271. The lid

272 is formed with a hole 272*a*, and an inner surface of the lid 272 is formed with three grease supply reservoirs (second grease reservoirs) 272*b* (see FIG. 25). The hollow section 271 has three pillar-like portions 273 arranged therein. The pillar-like portions 273 are connected to the hollow section 271 and the lid 272. The pillar-like portions 273 are each formed with a guide groove 273*a*. The guide grooves 273*a* communicates with the respective associated grease supply reservoirs 272*b*. Part of one end of each pillar-like portion 273 is cut out to thereby form a grease supply protrusion 273*b*.

The knob 209 includes a skirt 291 and a pushed portion 292. The skirt 291 has a hollow prismatic shape, and is formed with two holes 291*p*. The pushed portion 292 is in the form of a flat plate, and connected to one end of the skirt 291. The periphery of the pushed portion 292 protrudes from a side surface of the skirt 291.

The slider 210 includes a first hollow portion 211 and a second hollow portion 212.

The first hollow portion 211 has a hollow prismatic shape, and rails 211*a* are respectively formed at three portions of the sides of the first hollow portion 211. One end of each rail 211*a* protrudes from one end face of the first hollow portion 211, and the protruding portion serves as a grease supply protrusion 211*b* (see FIG. 26). The rails 211*a* are slidably inserted into the respective associated guide grooves 273*a* of the casing 207. This enables the slider 210 to slide on the casing 207. When the slider 210 is lifted by a click board 31, the grease supply protrusions 211*b* are inserted into the respective associated grease supply reservoirs 272*b* of the lid 272.

The first hollow portion 211 has one end thereof formed with three overhang portions 211*c* adjacent to the rails 211*a*. The overhang portions 211*c* are each formed with a grease supply reservoir 211*d*. The grease supply reservoirs 211*d* receive one ends of the rails 211*a*. Further, when the slider 210 is lifted by the click board 31, the grease supply reservoirs 211*d* receive the grease supply protrusions 273*b* of the pillar-like portions 273, respectively.

The first hollow portion 211 has an inner side wall provided with a pushing piece 211*e* for pushing the switch body 3, and a reinforcing plate 211*f* supporting the pushing piece 211*e* (see FIG. 26).

The second hollow portion 212 has a hollow prismatic shape. It is next smaller in size than the first hollow portion 211, and connected to the other end of the first hollow portion 211. The second hollow portion 212 protrudes from the casing 207 via the hole 272*a*. The second hollow portion 212 has side surfaces formed with two protrusions 212*a*. The protrusions 212*a* are inserted into the associated holes 291*p* of the knob 209. This fixes the knob 209 to the second hollow portion 212

The second embodiment provides the same advantageous effects as provided by the first embodiment.

It is further understood by those skilled in the art that the foregoing are the preferred embodiments of the present invention, and that various changes and modification may be made thereto without departing from the spirit and scope thereof.

What is claimed is:

1. A push type switch comprising:

a switch body;

a fixing member to which said switch body is rigidly fixed;

a movable member slidably supported by said fixing member such that said movable member transmits a pushing force to said switch body; and a grease applied to sliding portions of said fixing member and said movable member, wherein a viscosity of said grease is within a range of 16.7 to 45.8 Pa*s, wherein a guide groove is formed in one of said fixing member and said movable member, and a rail that slides relative to said guide groove is formed on the other of said fixing member and said movable member, and wherein a first grease reservoir is formed in at least one of said guide groove and said rail.

2. A push type switch as claimed in claim 1, wherein a second grease reservoir is formed in one end of either said guide groove or said rail.

3. A push type switch comprising:

a switch body;

a fixing member to which said switch body is rigidly fixed;

a movable member slidably supported by said fixing member such that said movable member transmits a pushing force to said switch body; and a grease applied to sliding portions of said fixing member and said movable member, wherein a viscosity of said grease is within a range of 16.7 to 45.8 Pa*s, wherein said grease is a fluorine-based grease, wherein a guide groove is formed in one of said fixing member and said movable member, and a rail that slides relative to said guide groove is formed on the other of said fixing member and said movable member, and wherein a first grease reservoir is formed in at least one of said guide groove and said rail.

4. A push type switch as claimed in claim 3, wherein a second grease reservoir is formed in one end of either said guide groove or said rail.

* * * * *